US011174640B2

(12) United States Patent
Yonezawa

(10) Patent No.: US 11,174,640 B2
(45) Date of Patent: Nov. 16, 2021

(54) FIXTURE FOR MUTUALLY FIXING A GRID AND A SECOND GRID

(71) Applicant: RISE VALLEY Co., Ltd., Oomuta (JP)

(72) Inventor: Hajime Yonezawa, Oomuta (JP)

(73) Assignee: RISE VALLEY Co., Ltd., Oomuta (JP)

( * ) Notice: Subject to any disclaimer, the term of this patent is extended or adjusted under 35 U.S.C. 154(b) by 0 days.

(21) Appl. No.: 17/261,435

(22) PCT Filed: Oct. 31, 2019

(86) PCT No.: PCT/JP2019/042817

§ 371 (c)(1),
(2) Date: Jan. 19, 2021

(87) PCT Pub. No.: WO2020/105390

PCT Pub. Date: May 28, 2020

(65) Prior Publication Data

US 2021/0317660 A1 Oct. 14, 2021

(30) Foreign Application Priority Data

Nov. 20, 2018 (JP) ..... JP2018-217749

(51) Int. Cl.
*E04C 5/16* (2006.01)

(52) U.S. Cl.
CPC ..... *E04C 5/166* (2013.01); *E04C 5/168* (2013.01)

(58) Field of Classification Search
CPC ..... E04C 5/166; E04C 5/168; E04C 5/0636
See application file for complete search history.

(56) References Cited

U.S. PATENT DOCUMENTS 1,637,742 A * 8/1927 Edge ..... E04C 5/168 52/685
1,908,105 A * 5/1933 Bitney ..... E04C 5/168 52/686

(Continued)

FOREIGN PATENT DOCUMENTS

JP S51-5818 A 1/1976
JP 3095881 U * 8/2003

(Continued)

*Primary Examiner* — Adriana Figueroa
(74) *Attorney, Agent, or Firm* — Bret E. Field; Bozicevic, Field & Francis LLP

(57) ABSTRACT

The present invention provides a fixture with which a plurality of grids can be definitely constructed in a short period of time even by an inexperienced worker without causing the worker to do heavy work. In substantially center positions in the lengthwise direction of bottom portions of first frame members, a pair of third frame members included in connecting means are provided. In the third frame member, a base portion is caused to stand on a bottom portion of the first frame member. One of arms of a U-shape of the base portion works as a holding portion included in the connecting means, and the end of the holding portion is bent inward of the base portion to form a connection bent portion having a function to engage with a circumferential surface of a vertical wire material or a lateral wire material of a second welded wire mesh, and a function to prevent the vertical wire material or the lateral wire material of the second welded wire mesh from coming off from the connecting means.

11 Claims, 14 Drawing Sheets

(56) References Cited

U.S. PATENT DOCUMENTS

| | | | | |
|---|---|---|---|---|
| 2007/0295873 | A1* | 12/2007 | Schulze | E04C 5/168<br>248/251 |
| 2014/0115995 | A1* | 5/2014 | Baldoni | E04C 5/166<br>52/687 |

FOREIGN PATENT DOCUMENTS

| | | | |
|---|---|---|---|
| JP | 3095881 | U | 8/2003 |
| JP | 2010-189855 | A | 9/2010 |
| JP | 2019-27269 | A | 2/2019 |
| JP | 2019-39287 | A | 3/2019 |
| JP | 2020-56188 | A | 4/2020 |
| JP | 2020-63616 | A | 4/2020 |
| WO | WO2018173650 | A1 | 9/2018 |

* cited by examiner

FIXTURE FOR MUTUALLY FIXING A GRID AND A SECOND GRID

CROSS-REFERENCE TO RELATED APPLICATIONS

This application is the national phase under 35 U. S. C. § 371 of PCT International Application No. PCT/JP2019/042817 which has an International filing date of Oct. 31, 2019 and designated the United States of America.

FIELD

The present invention relates to a fixture for mutually fixing a plurality of grids each including vertical wire materials and lateral wire materials arranged in a grid shape, such as a welded wire mesh or a mesh fence, to be buried in concrete.

BACKGROUND

When concrete is placed for building a structure such as a floor of a building, a plurality of welded wire meshes are buried in the concrete for increasing the strength of the structure and preventing the occurrence of cracks in the structure.

FIG. 13 is an explanatory diagram illustrating a conventional construction method for a welded wire mesh, and in this drawing, WM denotes a welded wire mesh. The welded wire mesh WM includes a plurality of vertical wire materials W1 and lateral wire materials W2 arranged in a grid shape, and intersection where the vertical wire materials W1 and the lateral wire materials W2 cross each other are mutually fixed by welding.

A formwork not shown is provided to stand around a construction target region, and a plurality of welded wire meshes WM are laid in the whole region within the formwork. At this point, welded wire meshes WM adjacent to each other are disposed to have their edges superimposed on each other in a plurality of squares (first squares in FIG. 13). Next, the welded wire meshes WM are successively lifted so as to provide spacers 30, such as blocks, between a construction target surface and the welded wire meshes WM, as illustrated in FIG. 13, and the welded wire meshes WM are placed on the spacers 30. Thus, the welded wire meshes WM are supported on the spacers 30, so as to hold the welded wire meshes WM in a position spaced from the construction target surface by a prescribed distance.

In the superimposed portions of the welded wire meshes WM adjacent to each other, the superimposed welded wire meshes WM are mutually bound with binding materials B made of a short wire material such as a wire in order to prevent occurrence of a mutual shift therebetween even if, for example, a worker performing an operation on the welded wire meshes steps thereon. After completing the construction of the welded wire meshes WM in the construction target region in this manner, concrete is provided into the formwork up to a prescribed depth for burying the welded wire meshes WM, and the surface of the provided concrete is leveled.

Such a binding operation is, however, necessary to be performed in all the regions where the welded wire meshes WM are superimposed on each other, and in addition, there are a large number of binding portions in each region, and therefore, in building a structure having a comparatively large area, not only a plurality of skilled workers are necessary but also it takes even skilled workers a long time of period to complete the operation of all the binding portions.

Therefore, Patent Document 1 (Japanese Patent Application Laid-Open No. 51-5818) proposes a connector for mutually linearly connecting ends of wire materials included in welded wire meshes adjacent to each other without superimposing the welded wire meshes.

On the other hand, in employing the above-described construction method, the welded wire meshes WM are merely placed on the spacers 30. Therefore, if a shift is caused between the welded wire meshes WM during the binding operation with the binding materials B, there arises a problem that the positions of the spacers 30 disposed in corresponding portions need to be adjusted again. Therefore, Patent Document 2 (Japanese Patent Application Laid-Open No. 2010-189855) discloses the following spacer.

FIG. 14 is a perspective view illustrating a usage state of the spacer disclosed in Patent Document 2. The spacer 31 is obtained by bending-molding a metal rod having a diameter of about 5 to 6 mm, and includes two rising portions 131*c* rising at a prescribed distance, an iron wire supporting portion 131*g* formed between the rising portions 131*c* for supporting an iron wire included in a welded wire mesh, and placing portions 131*b* formed to be bent horizontally from the lower ends of the rising portions 131*c* to be placed on a deck plate DP. Besides, the iron wire supporting portion 131*g* includes lower lateral portions 131*d* extended in a horizontal direction from the upper ends of the rising portions 131*c*, arc-shaped portions 131*e* curvedly rising from the lower lateral portions 131*d*, and an upper lateral portion 131*f* connecting the upper ends of the arc-shaped portions 131*e*, and is formed in a flat spiral shape in a side view. Here, an inner dimension between the lower lateral portions 131*d* and the upper lateral portion 131*f* is set to be larger than an outer diameter of the iron wire included in the welded wire mesh.

In using this spacer 31, a welded wire mesh WM placed on a deck plate DP is lifted, an iron wire included in the welded wire mesh WM is inserted into the iron wire supporting portion 131*g* in a spiral shape, and the welded wire mesh WM in this state is brought down. Thus, the placing portions 131*b* of the spacer 31 are brought into contact with the deck plate DP so as to cause the spacer 31 to stand on the deck plate DP. At this point, the iron wire inserted into the iron wire supporting portion 131*g* is supported on the lower lateral portions 131*d* of the spacer 31.

SUMMARY

When the connector disclosed in Patent Document 1 is used to connect welded wire meshes adjacent to each other, however, the following problems occur: It is necessary to linearly align ends of wire materials included in the welded wire meshes adjacent to each other, and this aligning operation takes a time, and in addition, an operation of connecting the ends of the wire materials by using the connector takes a comparatively long time.

On the other hand, in using the spacer 31 disclosed in Patent Document 2, the following problems occur: An operation of inserting an iron wire of a welded wire mesh WM into the wire supporting portion 131*g* of the spacer 31 needs to be performed with the welded wire meshes WM partly superimposed on each other lifted by a worker as described above, and hence the worker should do heavy work. In addition, it takes a long time to attach the spacer 31 to the iron wire of the welded wire mesh WM. On the other hand, when the iron wire included in the welded wire mesh WM is inserted into the wire supporting portion 131*g* in a spiral shape, the spacer 31 follows the movement of the welded wire mesh WM thereafter. Since the spacer 31 is not fixed on the welded wire mesh WM, however, if the position of the welded wire mesh WM is to be adjusted because the laid welded wire mesh WM has been shifted, the iron wire having been inserted into the iron wire supporting portion 131*g* of the spacer 31 may be shifted from the lower lateral portions 131*d* in some cases. In such cases, it is necessary to lift again the portion of the welded wire mesh WM where the spacer 31 has been attached to adjust the spacer 31 again.

Furthermore, even if such a spacer 31 is used, it is necessary to mutually bind welded wire meshes for constructing a plurality of welded wire meshes, and the above-described problem involved in the binding operation is not overcome.

The present invention is devised in consideration of these circumstances, and provides a fixture with which a plurality of grids can be definitely constructed in a short period of time even by an inexperienced worker without causing the worker to do heavy work. A fixture of the present invention is a fixture for mutually fixing a grid and a second grid to be superimposed on the grid, the grid including a plurality of vertical wire materials and a plurality of lateral wire materials arranged in a grid shape with intersections therebetween welded, and having a plurality of squares formed by the vertical wire materials and the lateral wire materials, wherein the fixture comprises at least a pair of first frame members disposed in parallel with each other at a distance according to a dimension of each square of the grid, and a pair of second frame members provided between the first frame members; wherein a fixing portion is provided at each end of the first frame members to be externally fit, for fixation, on each of the vertical wire materials or the lateral wire materials forming each of the squares of the grid; and wherein the fixture comprises connecting means having holding portions respectively provided to stand at a distance, according to an outer diameter of each of the vertical wire materials or the lateral wire materials, from each other in a lengthwise direction of the first frame members, for connecting the second grid by inserting a vertical wire material or a lateral wire material of the second grid into an insertion portion formed between the holding portions.

The fixture of the present invention is configured to mutually fix the grid and the second grid to be superimposed on the grid, the grid including a plurality of vertical wire materials and a plurality of lateral wire materials arranged in a grid shape with the intersections therebetween welded, and having a plurality of squares formed by the vertical wire materials and the lateral wire materials.

Specifically, the fixture has a structure in a grid shape in which a pair of second frame members are provided between at least a pair of first frame members disposed in parallel with each other at a distance according to the dimension of each square of the grid. The fixing portion to be externally fit, for fixation, on each of the vertical wire materials or the lateral wire materials forming the squares of the grid is provided at each end of the first frame members. The fixing portion is externally fit, for fixation, on each of the vertical wire materials or the lateral wire materials forming the squares to fix the fixture on the grid. At this point, since the fixture is fixed on the grid by externally fitting the fixing portion on each of the vertical wire materials or the lateral wire materials, even if the position of the grid is to be adjusted again on a construction target surface, labor for adjusting the position of the fixture again can be saved, and accordingly, a plurality of grids can be definitely constructed in a short period of time without causing a worker to do heavy work.

On the other hand, the holding portions are respectively provided to stand at a distance, according to the outer diameter of the vertical wire materials or the lateral wire materials, from each other in the lengthwise direction of the first frame members, so as to form connecting means for connecting the second grid by causing the vertical wire material or the lateral wire material of the second grid to be inserted into the insertion portion formed between the holding portions. When the vertical wire material or the lateral wire material of the second grid to be superimposed on the grid having the fixture fixed thereon is inserted into the insertion portion of the connecting means, the connecting means and the vertical wire material or the lateral wire material of the second grid are connected to each other, and thus, the grid having the fixture fixed thereon and the second grid can be fixed with one touch. In this manner, there is no need to perform the above-described binding operation, and a plurality of grids can be definitely constructed in a short period of time even by an inexperienced worker.

For the vertical wire material or the lateral wire material of the second grid having been inserted into the insertion portion, the holding portions are disposed in different positions in the lengthwise direction, so that the vertical wire material or the lateral wire material is connected to the connecting means not through a point but through a line, and thus the occurrence of a shift of the second grid is prevented.

In the fixture according to the present invention, each end of the holding portions is bent inward of the insertion portion to form a bent portion.

In the fixture of the present invention, each end of the holding portions is bent inward of the insertion portion to form a bent portion. Thus, the vertical wire material or the lateral wire material of the second grid inserted into the insertion portion of the connecting means can be prevented from coming off from the insertion portion, and a tip of the bent portion can be engaged with the circumferential surface of the vertical wire material or the lateral wire material of the second grid. In either case, a bond between the vertical wire material or the lateral wire material of the second grid inserted into the insertion portion and the connecting means is prevented from being released by an external force. On the other hand, in the latter case, the vertical wire material or the lateral wire material of the second grid is fixed on the bent portion, the occurrence of looseness within the insertion portion can be avoided.

In the fixture according to the present invention, a tip of the bent portion is formed as an inclined surface.

In the fixture of the present invention, the tip of the bent portion is formed as an inclined surface. Therefore, when the vertical wire material or the lateral wire material of the second grid is to be inserted into the insertion portion, the vertical wire material or the lateral wire material slides on the tip surface of the bent portion to enter the insertion portion, and hence, an operation of connecting the vertical wire material or the lateral wire material to the connecting means can be smoothly performed.

In the fixture according to the present invention, the inclined surface has an angle of about 45 degrees against a plane parallel to a plane formed by the first frame members.

In the fixture of the present invention, the inclined surface has an angle of about 45 degrees against the plane parallel to the plane formed by the first frame members. Thus, the operation of connecting the vertical wire material or the lateral wire material to the connecting means can be more smoothly performed, and in addition, an edge of the inclined surface at the tip of the bent portion can be engaged with the circumferential surface of the vertical wire material or the lateral wire material of the second grid connected to the connecting means.

In the fixture according to the present invention, a third frame member formed by linking each of the holding portions and an arm portion opposing the holding portion is fixed on each of the first frame members.

The fixture of the present invention includes the third frame member formed by linking the holding portion and the arm portion opposing the holding portion, and the third frame member is fixed on each of the first frame members. Thus, a spring force can be applied to the holding portion without affecting a portion fixed to the first frame member. Here, the holding portion and the arm portion are preferably linked in a U-shape because the spring force can be thus relatively increased.

On the other hand, the third frame member can be formed by molding a bar material, and hence the production cost of the third frame member can be made as inexpensive as possible.

In the fixture according to the present invention, a guiding portion for guiding the vertical wire material or the lateral wire material of the second grid toward the insertion portion is provided to extend from the arm portion of the third frame member.

In the fixture of the present invention, the guiding portion for guiding the vertical wire material or the lateral wire material of the second grid toward the insertion portion is provided to extend from the arm portion of the third frame member. In superimposing the second grid on the grid having the fixture attached thereon, if the vertical wire material or the lateral wire material of the second grid is not positioned above and between the holding portions of the fixture, the second grid is moved parallel to cause the vertical wire material or the lateral wire material to be positioned above the holding portions. At this point, if the guiding portion is not provided on the third frame member, the second grid comes into contact with the arm portion, which inhibits smooth parallel movement. In the fixture of the present invention, however, the guiding portion is provided to extend from the arm portion of the third frame member, the vertical wire material or the lateral wire material of the second grid slides on the guiding portion, and hence the second grid can be smoothly moved parallel.

In the fixture according to the present invention, the guiding portion is in a tapered shape having a height dimension reducing in a direction away from the arm portion.

In the fixture of the present invention, the guiding portion is in a tapered shape having a height dimension reducing in a direction away from the arm portion. In other words, in employing such a tapered shape, the guiding portion has a height dimension increasing in a direction away from the second frame member corresponding to the guiding portion, and thus, the parallel movement of the second grid performed when the vertical wire material or the lateral wire material of the second grid is not positioned above and between the holding members of the fixture can be more smoothly performed.

In the fixture according to the present invention, a gap between the guiding portion and an opposing one of the first frame members is set to be smaller than an outer diameter of the vertical wire material or the lateral wire material of the second grid.

In the fixture of the present invention, the gap between the guiding portion and the opposing first frame member is set to be smaller than the outer diameter of the vertical wire material or the lateral wire material of the second grid. Accordingly, if the vertical wire material or the lateral wire material of the second grid is not positioned above and between the holding portions of the fixture, the vertical wire material or the lateral wire material of the second grid is prevented from fitting in the gap, and the parallel movement can be prevented from being obstructed.

In the fixture according to the present invention, the holding portions are inclined inward toward between the first frame members or outward on an opposite side.

In the fixture of the present invention, the holding portions included in the connecting means are inclined inward toward between the first frame members or outward on the opposite side. Thus, a plurality of fixtures can be stacked on one another for transporting the fixtures, and thus, a transport density of the fixtures can be increased. Besides, an operation of forming the bent portion in the holding portion can be smoothly performed.

In the fixture according to the present invention, each of the first frame members is provided with a supporting portion formed by raising portions respectively spaced from ends thereof by a prescribed distance for supporting the grid fixed on the fixing portion in a height position spaced from a construction target surface.

In the fixture of the present invention, each of the first frame members is provided with the supporting portion formed by raising the portions respectively spaced from ends thereof by a prescribed distance for supporting the grid fixed on the fixing portion in a height position spaced from the construction target surface. Thus, center portions of the first frame members are brought into contact with the construction target surface of the grid, and the grid fixed on the fixing portions can be supported at a height position spaced from the construction target surface. Thus, the fixture functions also as a spacer.

In the fixture according to the present invention, the grid and the second grid are to be laid on a deck plate including a plurality of ridges provided to project at an appropriate interval, and having a valley between ridges adjacent to each other, and an outer dimension between the first frame members is set to be ½ or less of a width of each ridge of the deck plate.

In the fixture of the present invention, the outer dimension between the first frame members is set to be ½ or less of the width dimension of the ridge of the deck plate. In a case where the grid having the fixture attached thereon is to be laid on the deck plate including a plurality of ridges provided to project at an appropriate interval, and having a valley between ridges adjacent to each other, if one of the pair of the first frame members included in the fixture is positioned on a shoulder of the ridge of the deck plate, when a pressing force is applied to the second grid superimposed on the grid having the fixture attached thereon to connect the vertical wire material or the lateral wire material of the second grid to the connecting means of the fixture, the first frame member positioned on the shoulder of the ridge of the deck plate enters a valley of the deck plate, which warps the grid and the second grid. In contrast, when the dimension between the first frame members of the fixture is set to a value not more than ½ of the width of the ridge of the deck plate, both of the first frame members are avoided from positioning on a shoulder of the ridge of the deck plate, and hence occurrence of the warp of the grid and the second grid otherwise caused as described above can be prevented.

The above and further objects and features will more fully be apparent from the following detailed description with accompanying drawings.

DETAILED DESCRIPTION

A fixture according to the present invention will now be described in detail with reference to the accompanying drawings. It is noted that a fixture described in an embodiment of the present invention is merely an example for describing the scope of the present invention, and it goes without saying that the present invention encompasses changes and modifications not departing from the spirit and scope of the present invention.

First Embodiment

Figure 1:
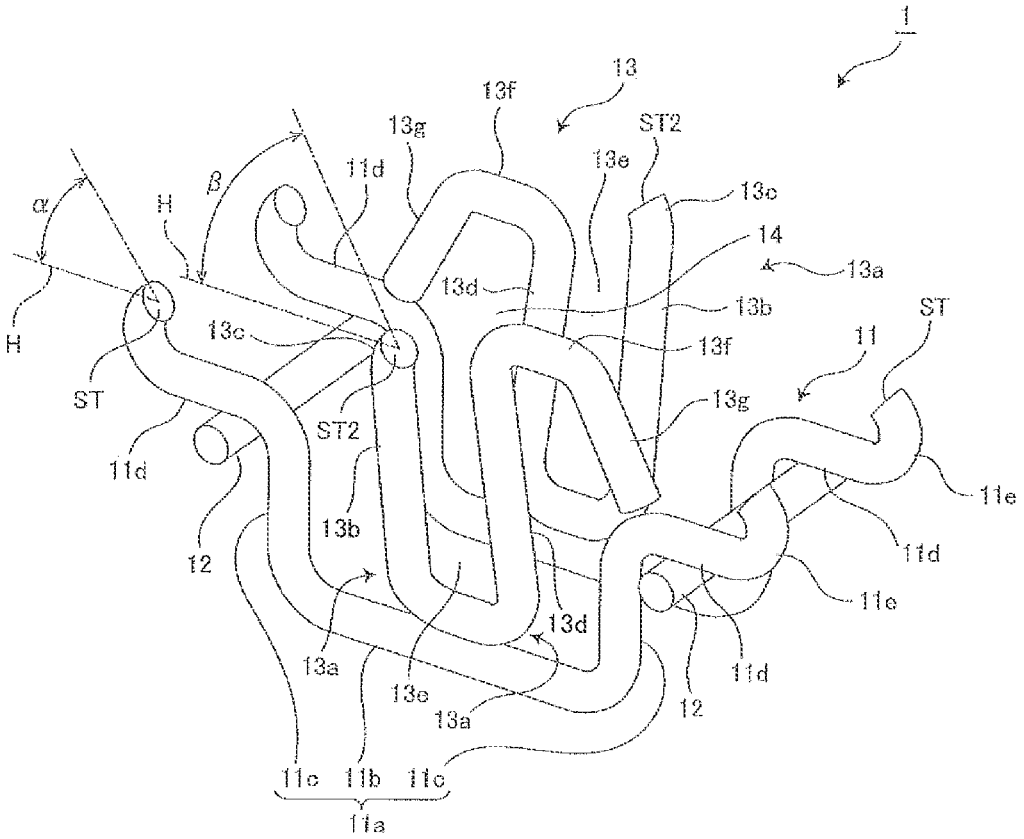
FIG. 1 is a perspective view illustrating an example of a fixture according to the present invention.
Figure 2:
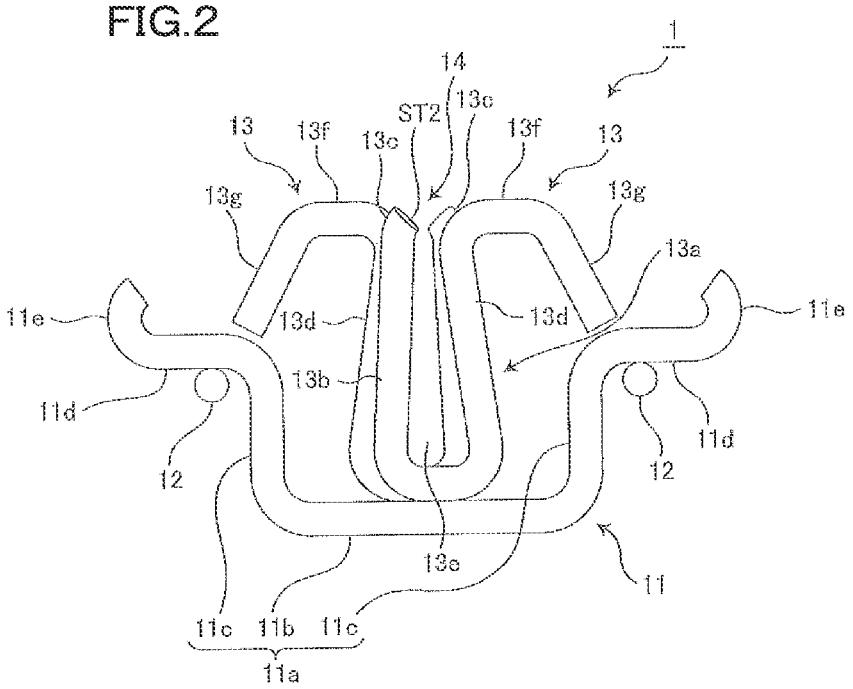
FIG. 2 is a front view of the fixture of FIG. 1.
Figure 3:
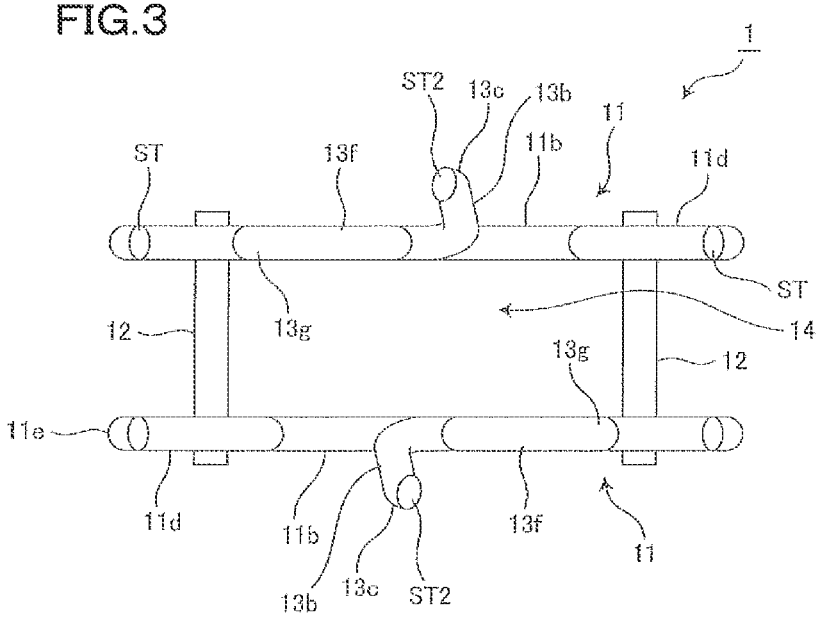
FIG. 3 is a plan view of the fixture of FIG. 1.

FIG. 1 is a perspective view illustrating an example of a fixture according to the present invention, and FIG. 2 and FIG. 3 are respectively a front view and a plan view of the fixture of FIG. 1. In FIGS. 1 to 3, like reference signs are used to refer to corresponding portions.

The fixture 1 includes a pair of first frame members 11 each obtained by molding a rod material into an inverted convex shape, and a pair of second frame members 12 each in a short rod shape, and a fixing portion lie to be fixed on a welded wire mesh is provided in each of ends of the first frame members 11. These first frame members 11 and second frame members 12 are fixed to form a grid shape in a plan view as described below.

The first frame member 11 includes a main portion 11*a* (supporting portion) formed into a U-shape as a whole, having rising portions 11*c* respectively formed by raising both ends of a bottom portion 11*b* in a linear shape capable of coming into contact with a construction target surface. Thus, a spring force is generated in the rising portions 11*c* of the main portion 11*a*. The main portion 11*a* is provided, at both ends thereof, short arm portions 11*d* extending to be away from each other in substantially parallel to the bottom portion 11*b*. The tips of the arm portions 11*d* are caused to rise in parallel to the rising portions 11*c* to be bent outward to form the fixing portions 11*e* in a hook shape. In other words, the fixing portions 11*e* are formed to bend inward. Incidentally, the linear bottom portion 11*b* is provided in the present embodiment, which does not limit the present invention. The bottom portion 11*b* may be in an appropriate shape such as an irregular shape or a wavy shape.

A dimension between the inner bottoms of the fixing portions 11*e* provided on the first frame member 11 is substantially the same as an outer dimension between vertical wire materials adjacent to each other or lateral wire materials adjacent to each other included in a welded wire mesh on which the fixture 1 is to be attached. A curvature of the fixing portions 11*e* is substantially the same as a curvature of the circumferential surface of the vertical wire material or the lateral wire material. The fixing portions 11*e* have such a length that they can externally fit onto the circumferential surface of the vertical wire material or the circumferential surface of the lateral wire material of the welded wire mesh in a range slightly exceeding ¼ in the circumferential direction of the circumferential surface. Besides, a tip surface ST of each of the fixing portions 11*e* is formed as an inclined surface having an angle $\alpha$ of about 45 degrees against a plane H parallel to a plane formed by the bottom portions 11*b* of the main portions 11*a* disposed in parallel. Thus, the tips of the tip surfaces ST are engaged with the circumferential surface of the vertical wire material or the circumferential surface of the lateral wire material of the welded wire mesh.

A dimension between the first frame members 11 disposed in parallel is set to be smaller than a dimension between the vertical wire materials adjacent to each other or the lateral wire materials adjacent to each other included in the welded wire mesh on which the fixture 1 is to be attached. The second frame members 12 are disposed across on the circumferential surfaces of the arm portions 11*d* of the first frame members 11 in positions on the side of the bottom portions 11*b* of the first frame members 11. Also the length of the second frame members 12 is set to be smaller than the dimension between the vertical wire materials adjacent to each other or the lateral wire materials adjacent to each other included in the welded wire mesh on which the fixture 1 is to be attached. A dimension between the second frame members 12 disposed to oppose each other is also similarly set to be smaller than the dimension between the vertical wire materials adjacent to each other or the dimension between the lateral wire materials adjacent to each other.

Incidentally, in the fixture 1 illustrated in FIG. 1, the second frame members 12 are disposed across on the circumferential surfaces of the arm portions 11*d* of the first frame members 11 in the positions on the side of the bottom portions 11*b* of the first frame members 11, which does not limit the present invention. The second frame members 12 may be disposed across on the circumferential surfaces of the arm portions 11*d* in any of various positions, such as positions opposite to the bottom portions 11*b* of the first frame members 11, appropriate positions on the rising portions 11*c* of the first frame members 11, or appropriate positions on the bottom portions 11*b* of the first frame members 11.

In substantially center positions in the lengthwise direction of the bottom portions 11*b* of the first frame members 11, a pair of third frame members 13 included in connecting means 14 for connecting a vertical wire material or a lateral wire material of a second welded wire mesh to be superimposed on the welded wire mesh having the fixture 1 attached thereon are respectively provided.

In the third frame member 13, a base portion 13*a* formed by bending a bar material into a substantially U-shape is caused to stand on the bottom portion 11*b* of the first frame member 11, and a bottom circumferential surface of the base portion 13*a* is fixed on the circumferential surface of the bottom portion 11*b*. One of arms of the U-shape of the base portion 13*a* is formed as a holding portion 13*b* included in the connecting means 14, and the end of the holding portion 13*b* is bent inward of the base portion 13*a* to form a connection bent portion 13*c* having a function to engage with the circumferential surface of the vertical wire material or the lateral wire material of the second welded wire mesh, and a function to prevent the vertical wire material or the lateral wire material of the second welded wire mesh from coming off from the connecting means 14. A tip surface ST2 of the connection bent portion 13*c* is formed as an inclined surface having an angle β of about 45 degrees against the plane H parallel to the plane formed by the bottom portions 11*b* of the main portions 11*a* disposed in parallel as described above. Thus, the tip of the tip surface ST2 is engaged with the circumferential surface of the vertical wire material or the lateral wire material of the welded wire mesh so that it can be fixed.

Incidentally, the angles α and β are both about 45 degrees in the present embodiment, which does not limit the present invention. The angles α and β, or at least the angle β may be a larger angle of, for example, about 80 to 90 degrees. In this case, the height of the fixture 1 can be made as small as possible.

The third frame members 13 are fixed on the first frame members 11 to be plane symmetric with each other. Thus, the holding portions 13*b* of the third frame members 13 are disposed to oppose each other at an appropriate distance, and an insertion portion 13*e* into which the vertical wire material or the lateral wire material of the second welded wire mesh is to be inserted is formed between the holding portions 13*b* in a plan view as illustrated in FIG. 2.

Here, for the vertical wire material or the lateral wire material of the second grid having been inserted into the insertion portion 13*e*, the holding portions 13*b* are disposed in different positions in the lengthwise direction, so that the vertical wire material or the lateral wire material is connected to the connecting means 14 not through a point but through a line, and thus the occurrence of a shift of the second grid is prevented. Here, since the vertical wire material or the lateral wire material has not only a length but also a prescribed width, it can be said that the vertical wire material or the lateral wire material is connected to the connecting means 14 through a plane.

Besides, as illustrated in FIG. 1 and FIG. 2, the holding portions 13*b* are inclined to be gradually spaced outward from the first frame members 11 in a direction from their bottoms toward the connection bent portions 13*c*. Thus, a plurality of fixtures 1 can be stacked on one another for transport, and therefore, a transport density of the fixtures 1 can be increased. Besides, an operation of forming the connection bent portion 13*c* in the holding portion 13*b* can be smoothly performed. It goes without saying that the holding portions 13*b* having the connection bent portions 13*c* formed therein may not be thus inclined.

The holding portions 13*b* can be warped in a direction away from each other, and when a pressing force is applied to the vertical wire material or the lateral wire material of the second welded wire mesh having been guided above and between the holding portions 13*b*, the holding portions 13*b* are warped in the direction away from each other, and hence the width dimension between the holding portions 13*b* becomes relatively large. Thus, the vertical wire material or the lateral wire material passes between the holding portions 13*b* to be inserted into the insertion portion 13*e*, and then, the holding portions 13*b* restore to original attitude. Therefore, the width dimension between the holding portions 13*b* restores, the connection bent portions 13*c* provided at the ends of the holding portions 13*b* engage with the circumferential surface of the vertical wire material or the lateral wire material having been inserted into the insertion portion 13*e*, or the connection bent portions 13*c* prevent the vertical wire material or the lateral wire material having been inserted into the insertion portion 13*e* from coming off from the insertion portion 13*e*. In this manner, the vertical wire material or the lateral wire material is connected to the connecting means 14.

On the other hand, ends of opposing arm portions 13*d* opposing the holding portions 13*b* of the base portions 13*a* are molded to extend in reverse directions in substantially parallel to the bottom portions 11*b* of the first frame members 11 to form ceiling portions 13*f*, and then, to be gradually lowered in a tapered shape toward corners between the rising portions 11*c* and the arm portions 11*d* of the corresponding first frame member 11. Thus, guiding portions 13*g* for guiding the second welded wire mesh toward the holding portions 13*b* as described below are formed.

A gap is formed between the guiding portions 13*g* and a corresponding one of the first frame members 11, and the dimension of the gap is set to a value smaller than the diameter of the vertical wire material or the lateral wire material included in the welded wire mesh. Thus, the vertical wire material or the lateral wire material of the second welded wire mesh can be prevented from fitting in the gap, and an operation of guiding the vertical wire material or the lateral wire material of the second welded wire mesh to between the holding portions 13*b* can be smoothly performed. On the other hand, since the ceiling portions 13*f* are provided, the length of the guiding portions 13*g* can be correspondingly reduced, and load bearing strength of the guiding portions 13*g* is improved.

As described below, in superimposing the second welded wire mesh on the welded wire mesh having the fixture 1 attached thereon, if the vertical wire material or the lateral wire material of the second welded wire mesh is not disposed above and between the pair of the holding portions 13*b* of the fixture 1, the second welded wire mesh is moved parallel to cause the vertical wire material or the lateral wire material to be disposed above and between the holding portions 13*b*. Here, if the guiding portions 13*g* are not provided in the third frame members 13, the second welded wire mesh comes into contact with the base portions 13*b*, which inhibits smooth parallel movement. In the fixture 1 of the present invention, however, since the guiding portions 13*g* are provided in the third frame members 13, the vertical wire material or the lateral wire material of the second welded wire mesh slides on the guiding portions 13*g* and the ceiling portions 13*f*, and thus, the second welded wire mesh can be smoothly moved parallel.

Incidentally, the ceiling portions 13*f* may not be provided in the third frame members 13 if necessary, but the ceiling portions 13*f* are preferably provided because thus an alignment operation between the vertical wire material or the lateral wire material of the second welded wire mesh having been moved parallel and the pair of holding portions 13*b* of the fixture 1 can be easily performed.

The holding portion 13*b* and the opposing arm portion 13*d* included in the base portion 13*a* are formed in a tapered shape such that a dimension therebetween is gradually reduced from the bottom side to the ceiling side as illustrated in FIG. 2, and thus, a spring force inward of the base portions 13*a* is generated in the holding portions 13*b*.

In the present embodiment, the holding portion 13*b* and the opposing arm portion 13*d* included in the base portion 13*a* are molded in a tapered shape, which does not limit the present invention, and at least the holding portion 13*b* included in the base portion 13*a* may be molded in a tapered shape.

Besides, the height dimensions of the holding portion 13*b*, the opposing arm portion 13*d* and the ceiling portion 13*f* of the third frame member 13 are all larger than the height dimension of the fixing portions lie of the first frame member 11, and thus, when the fixing portions lie of the first frame members 11 are fixed on the vertical wire materials or the lateral wire materials adjacent to each other of the welded wire mesh, the holding portion 13*b*, the corresponding arm portion 13*d* and the ceiling portion 13*f* of the third frame member 13 protrude beyond the welded wire mesh.

As described below, since the fixture 1 is precedently fixed on one welded wire mesh, when the vertical wire material or the lateral wire material of a second welded wire mesh is connected to the connecting means 14 of the fixture 1 as described above, the welded wire mesh and the second welded wire mesh superimposed thereon can be mutually fixed.

If the construction target surface is a deck plate having irregularities of a plurality of ridges, a dimension between the first frame members 11 disposed to oppose each other is set to a value not more than ½ of the width of the ridge of the deck plate. If one of the pair of first frame members 11 of the fixture 1 is positioned on a shoulder of a ridge of the deck plate, when a pressing force is applied to the second welded wire mesh superimposed on the welded wire mesh having the fixture 1 attached thereon as described above to connect the vertical wire material or the lateral wire material of the second welded wire mesh to the connecting means 14 of the fixture 1, the first frame member 1 positioned on the shoulder of the ridge of the deck plate enters a valley of the deck plate, which warps the welded wire mesh and the second welded wire mesh. In contrast, when the dimension between the first frame members 11 of the fixture 1 is set to the value not more than ½ of the width of the ridge of the deck plate, both of the first frame members 11 are avoided from positioning on a shoulder of the ridge of the deck plate, and hence the welded wire mesh and the second welded wire mesh can be prevented from warping as described above.

Figure 4:
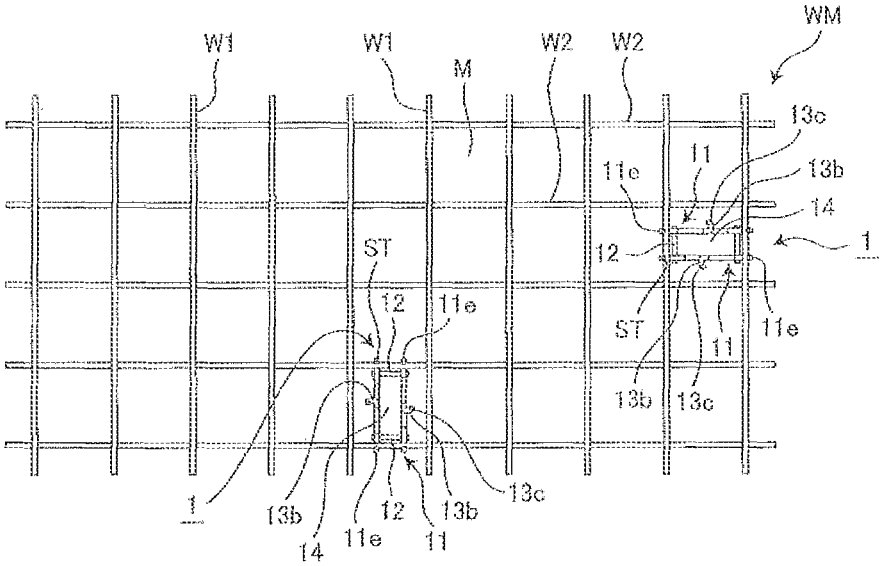
FIG. 4 is a plan view illustrating an example in which a plurality of fixtures are fixed on a welded wire mesh.

FIG. 4 is a plan view illustrating an example in which a plurality of fixtures are fixed on a welded wire mesh. Incidentally, like reference signs are used in this drawing to refer to the corresponding portions illustrated in FIG. 1 to FIG. 3.

As illustrated in FIG. 4, the welded wire mesh WM includes a plurality of vertical wire materials W1 and a plurality of lateral wire materials W2 arranged in a grid shape at a prescribed distance, with intersections therebetween welded. Besides, in the welded wire mesh WM, a plurality of squares M each surrounded by the vertical wire materials W1 and the lateral wire materials W2 are formed in a plurality of rows and a plurality of columns. Here, in the welded wire mesh WM illustrated in FIG. 4, the length of the vertical wire materials W1 is smaller than the length of the lateral wire materials W2, and thus, a rectangular grid is formed. Incidentally, the length of the vertical wire materials W1 may be larger than the length of the lateral wire materials W2, or the length of the vertical wire materials W1 may be the same as the length of the lateral wire materials W2.

Besides, the vertical wire materials W1 of the welded wire mesh WM are disposed on one plane, and the lateral wire materials W2 are disposed on another plane, and assuming that a side where the vertical wire materials W1 are disposed on the lateral wire materials W2 is a front side of the welded wire mesh WM, a side where the vertical wire materials W1 are disposed below the lateral wire materials W2 is a rear side of the welded wire mesh WM. In the case illustrated in FIG. 4, the welded wire mesh WM is laid with the front side upward. Incidentally, the welded wire mesh WM may be laid with the rear side upward in some cases as described below.

In the case illustrated in FIG. 4, among the plurality of squares M arranged in a plurality of rows and a plurality of columns, the fractures 1 are respectively disposed in a square M disposed at a top column or an end column and in a substantially center position along the vertical direction, and a square M disposed at a top row or an end row and in a substantially center position along the lateral direction. The former fixture 1 is in an attitude where the first frame members 11 are in parallel to the lateral wire materials W2 adjacent to each other and forming the corresponding square M, and the fixing portions lie provided at the ends of the first frame members 11 are externally fit and fixed on the vertical wire materials W1 adjacent to each other and forming the corresponding square M. On the other hand, the latter fixture 1 is in an attitude where the first frame members 11 are in parallel to the vertical wire materials W1 adjacent to each other and forming the corresponding square M, and the fixing portions lie provided at the ends of the first frame members 11 are externally fit and fixed on the lateral wire materials W2 adjacent to each other and forming the corresponding square M.

Besides, in the former fixture 1, the holding portions 13*b* included in the connecting means 14 are arranged along the lengthwise direction of the vertical wire materials W1, and thus, the vertical wire materials of the second welded wire mesh are connected to the connecting means 14. On the other hand, in the latter fixture 1, the holding portions 13*b* of the connecting means 14 are arranged along the lengthwise direction of the lateral wire materials W2, and thus, the lateral wire materials of the second welded wire mesh are connected to the connecting means 14.

Here, the tip surfaces ST of the fixing portions lie are formed as the inclined surfaces having the angle $\alpha$ against the plane H (see FIG. 1) of substantially 45 degrees as described above. Therefore, when the fixing portions lie are to be externally fit on the vertical wire materials W1 or the lateral wire materials W2 of the welded wire mesh WM for fixing the fixture 1 on the welded wire mesh WM, the circumferential surfaces of the vertical wire materials W1 or the lateral wire materials W2 slide on the tip surfaces ST, so that the vertical wire materials W1 or the lateral wire materials W2 can be easily inserted into the fixing portions lie.

At this point, for example, the fixture 1 is placed with the bottom portion 11*b* of the fixture 1 in contact with a construction target surface in an appropriate position on the construction target surface, and the welded wire mesh WM is placed with a prescribed square M of the welded wire mesh WM positioned on the fixture 1. Thus, the vertical wire materials W1 adjacent to each other or the lateral wire materials W2 adjacent to each other and forming the square M are brought into contact with the tip surfaces ST of the fixing portions 11*e*. When a pressing force is applied to the welded wire mesh WM under this state, the vertical wire materials W1 or the lateral wire materials W2 slide on the tip surfaces ST as described above, and thus, the vertical wire materials W1 or the lateral wire materials W2 can be fit in the fixing portions lie with one touch.

In this manner, a plurality of welded wire meshes WM on which the fixtures 1 are fixed in prescribed positions are used to construct the welded wire meshes WM on the construction target surface.

Figure 5:
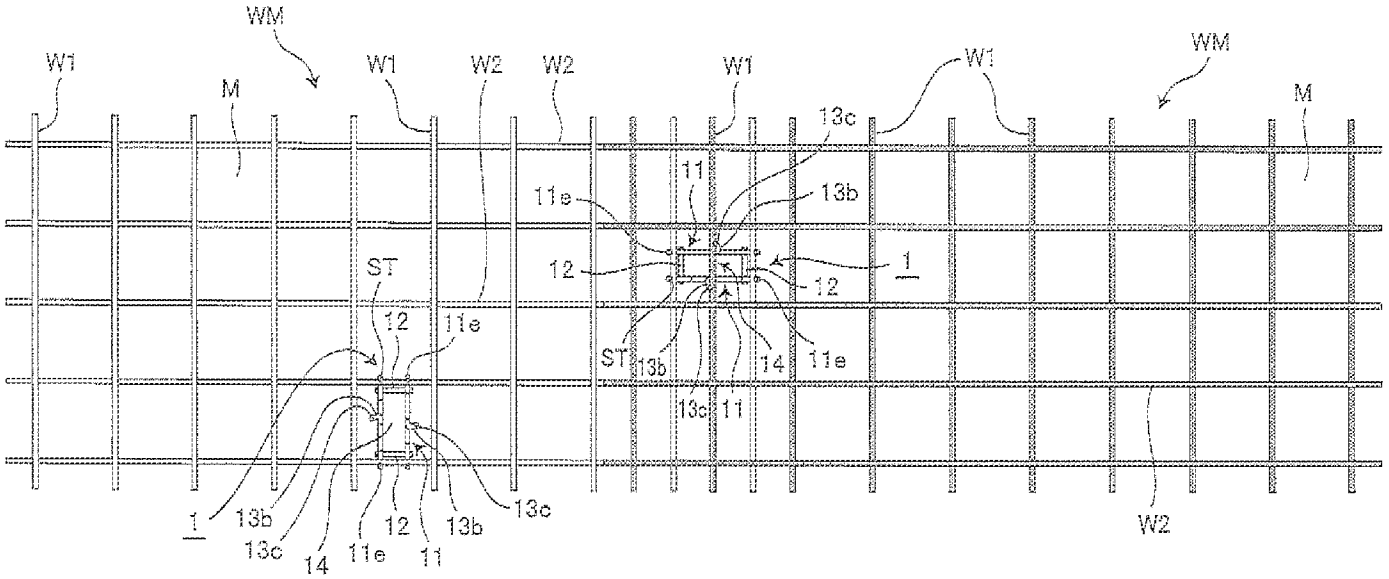
FIG. 5 is a plan view illustrating a state where two welded wire meshes on which the fixtures have been fixed as illustrated in FIG. 4 are constructed.
Figure 6:
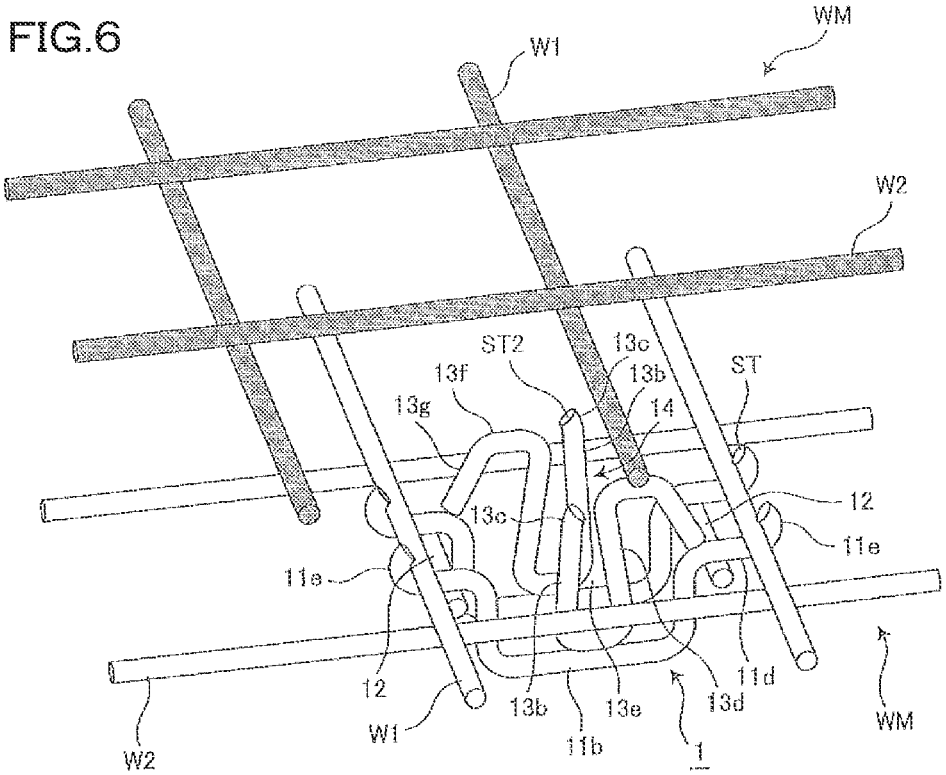
FIG. 6 is an enlarged perspective view of a portion where the two welded wire meshes are superimposed on each other.
Figure 7:
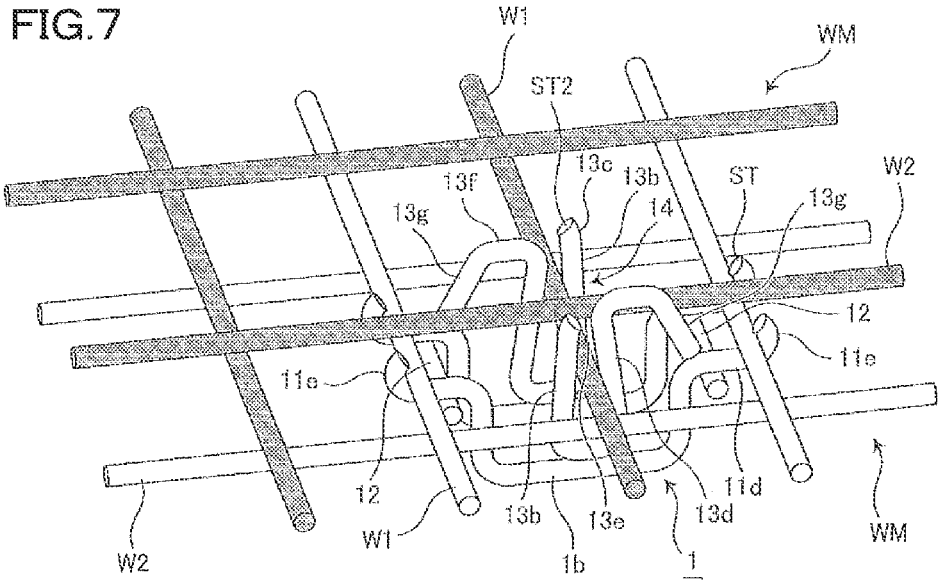
FIG. 7 is another enlarged perspective view of the portion where the two welded wire meshes are superimposed on each other.

FIG. 5 is a plan view illustrating a state where the welded wire mesh WM having the fixtures 1 fixed thereon as illustrated in FIG. 4 and the second welded wire mesh WM are constructed, and FIG. 6 and FIG. 7 are enlarged perspective views illustrating portions where the two welded wire meshes WM are superimposed on each other. Incidentally, in the two welded wire meshes WM illustrated in FIG. 5, the welded wire mesh WM disposed on the left hand side in the drawing is disposed with the front side upward, the welded wire mesh WM disposed on the right hand side is disposed with the rear side upward, and the fixtures 1 are fixed on the welded wire mesh WM of the front side in the same positions and the same attitudes as those in the welded wire mesh WM illustrated in FIG. 4. Incidentally, like reference signs are used in these drawings to refer to the corresponding portions illustrated in FIG. 1 to FIG. 3.

As illustrated in FIG. 5, the welded wire mesh WM (disposed on the left hand side in FIG. 5) on which the fixtures 1 are fixed with the front side upward as described above is placed in an appropriate position on the construction target surface, the welded wire mesh WM with the rear side upward (disposed on the right hand side in FIG. 5) is disposed along the lengthwise direction of the welded wire mesh WM on a side of a short side where the fixture 1 is fixed at a corner of the front welded wire mesh WM, and a side of a short side of the rear welded wire mesh WM is disposed on the front welded wire mesh WM with one and a half squares of the welded wire meshes superimposed on each other. Thus, as illustrated in FIG. 6, the vertical wire material W1 of the rear welded wire mesh WM is disposed above and between the holding portions 13*b* included in the connecting means 14 of the fixture 1 fixed at the corner of the front welded wire mesh WM.

At this point, if the vertical wire material W1 of the rear welded wire mesh WM is not disposed above and between the holding portions 13*b* of the fixture 1 fixed at the corner of the front welded wire mesh WM but is shifted, the rear welded wire mesh WM is moved parallel to cause the vertical wire material W1 of the rear welded wire mesh WM to be disposed above and between the holding portions 13*b* of the fixture 1 on the front welded wire mesh WM. Since the guiding portions 13*g* (see FIG. 6) are provided on the third frame members 13, the vertical wire material W1 of the rear welded wire mesh WM slides on one of the guiding portions 13*g* and the ceiling portions 13*f* (see FIG. 6) of the third frame members 13, and hence the rear welded wire mesh WM can be smoothly moved parallel.

As described above, after the vertical wire material W1 of the rear welded wire mesh WM is disposed above and between the holding portions 13*b* of the fixture 1 fixed at the corner of the front welded wire mesh WM, a pressing force is applied to the vertical wire material W1 of the rear welded wire mesh WM, and thus, the vertical wire material W1 is inserted into the insertion portion 13*e* between the holding portions 13*b* as illustrated in FIG. 7 to connect the vertical wire material W1 to the connecting means 14. Thus, the front welded wire mesh WM and the rear welded wire mesh WM can be definitely fixed with one touch.

Figure 8:
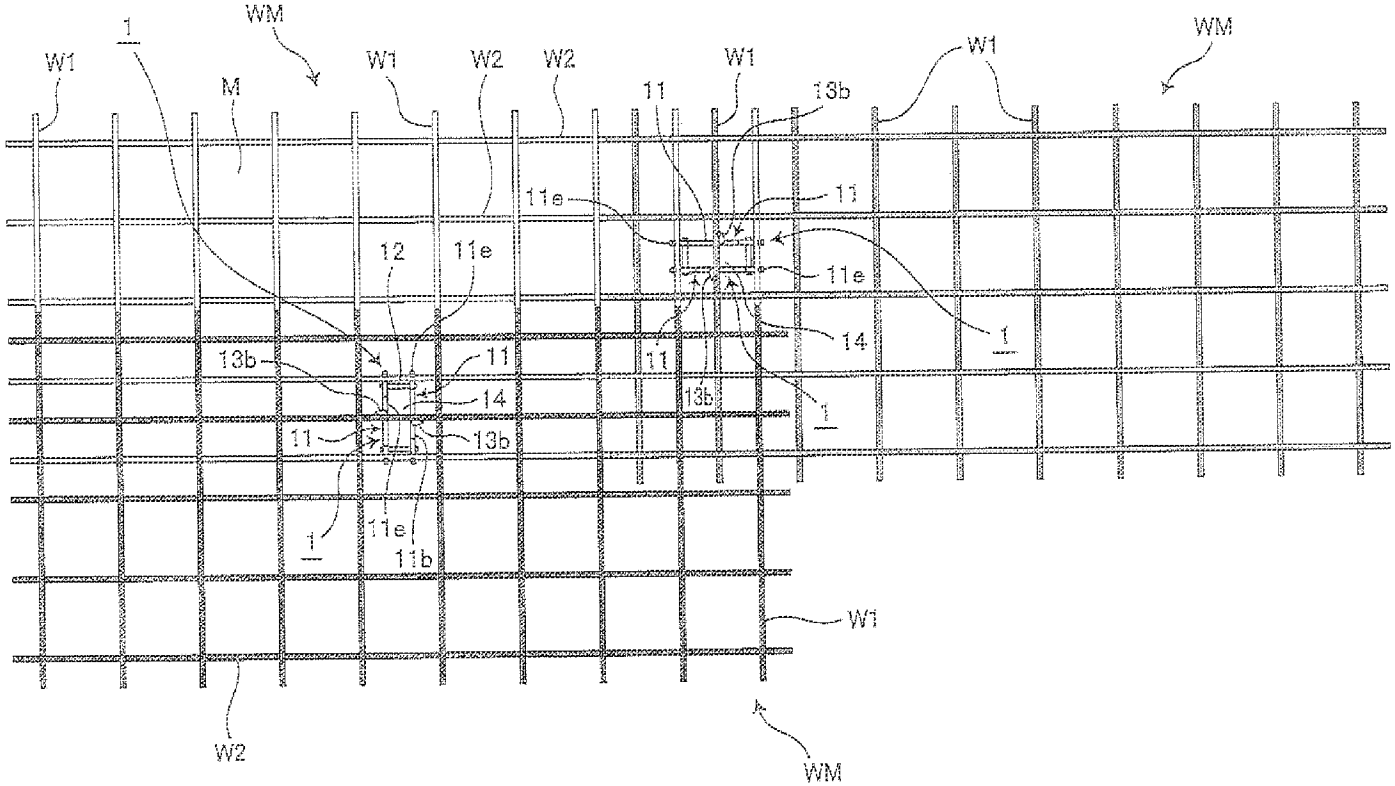
FIG. 8 is a plan view illustrating a state where another welded wire mesh is constructed on the two welded wire meshes constructed as illustrated in FIG. 5.
Figure 9:
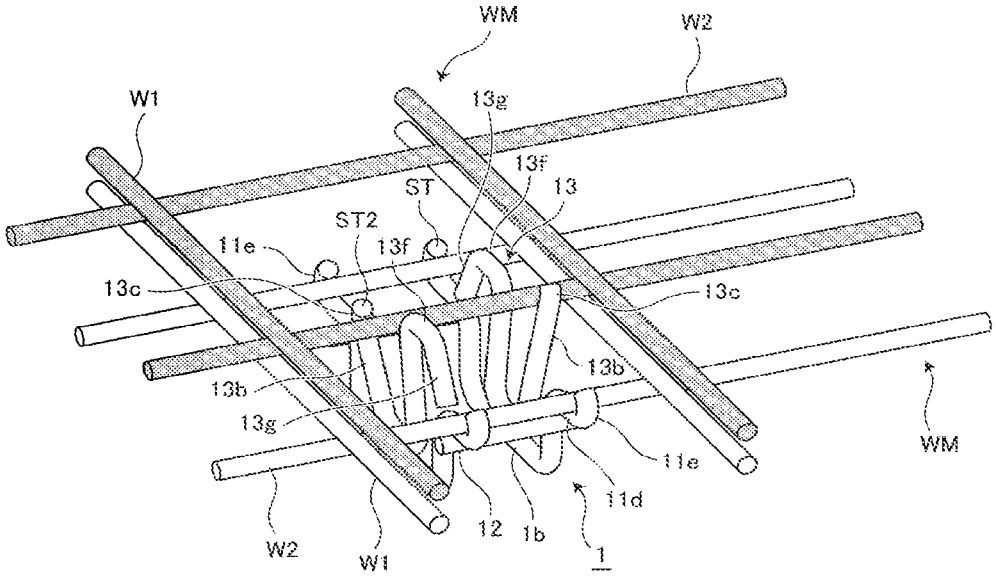
FIG. 9 is an enlarged perspective view of a portion where the two welded wire meshes illustrated in FIG. 8 are superimposed on each other.

Furthermore, FIG. 8 is a plan view illustrating a state where a third welded wire mesh WM is constructed on the two welded wire meshes WM having been constructed as illustrated in FIG. 5, and the third welded wire mesh WM is connected with the fixture 1 disposed on the square M disposed in the substantially center position along the lateral direction of the welded wire mesh WM of FIG. 4. Besides, FIG. 9 is an enlarged perspective view of a portion where the two welded wire meshes WM of FIG. 8 are superimposed on each other. Incidentally, in these drawings, like reference signs are used to refer to the corresponding portions illustrated in FIG. 5 to FIG. 7 to avoid redundant description thereof.

As illustrated in FIG. 8, the welded wire mesh WM with the front side upward (disposed on the lower left side in FIG. 8) is disposed on a side of a long side where the fixture 1 is fixed in the substantially center position in the lateral direction of the front welded wire mesh and in a direction perpendicular to the lengthwise direction of the welded wire mesh WM, and the side of the long side of the welded wire mesh WM is disposed on the front welded wire mesh WM with one and a half squares M of the welded wire mesh superimposed on each other. Thus, as illustrated in FIG. 8, the lateral wire material W2 of the upper welded wire mesh WM is disposed above and between the holding portions 13*b* included in the connecting means 14 of the fixture 1 fixed in the substantially center position in the lateral direction on the lower welded wire mesh WM.

At this point, if the lateral wire material W2 of the upper welded wire mesh WM is not disposed above and between the holding portions 13*b* of the fixture 1 fixed in the substantially center position in the lateral direction of the lower welded wire mesh WM and is shifted, the upper welded wire mesh WM is moved parallel to cause the lateral wire material W2 of the upper welded wire mesh WM to be disposed above and between the holding portions 13*b* of the fixture 1 of the lower welded wire mesh WM. In the same manner as described above, since the guiding portions 13*g* are provided on the third frame members 13 of the fixture 1, the vertical wire material W1 of the upper welded wire mesh WM slides on one of the guiding portions 13*g* and the ceiling portions 13*f* (see FIG. 9) of the third frame members 13, and hence the upper welded wire mesh WM can be smoothly moved parallel.

On the other hand, the lower welded wire mesh WM having the fixtures 1 fixed thereon has its front side upward and the upper welded wire mesh WM also has its front side upward. Therefore, as illustrated in FIG. 9, the vertical wire materials W1 of the lower welded wire mesh WM are positioned on the lateral wire materials W2 externally fit by the fixing portions 11*e* of the fixture 1 of the lower welded wire mesh WM, the lateral wire materials W2 of the upper welded wire mesh WM are in contact with the vertical wire materials W1 of the lower welded wire mesh WM, and a prescribed lateral wire material W2 out of the lateral wire materials W2 is inserted into the insertion portion 13*e* of the fixture 1. The height dimension of the holding portions 13*b* is set to a value with which the connection bent portions 13*c* are in a rigid contact with the circumferential surface of the lateral wire material W2 in this state, and thus, the connection bent portions 13*c* of the holding portions 13*b* engage with the circumferential surface of the lateral wire material W2 inserted into the insertion portion 13*e*, so as to fix the lateral wire material W2.

In other words, with the fixing portions lie of the fixture 1 externally fit on the lateral wire materials W2 adjacent to each other of the lower welded wire mesh WM so as to support the lower welded wire mesh WM by the fixture 1, the lateral wire materials W2 of the upper welded wire mesh WM are in contact with the vertical wire materials W1 disposed above the lateral wire materials W2 of the lower welded wire mesh WM. Under this state, the connection bent portions 13*c* of the fixture 1 are engaged with the circumferential surface of the lateral wire material W2 of the upper welded wire mesh WM, and hence the lower welded wire mesh WM and the upper welded wire mesh WM are sandwiched and fixed between the fixing portions lie of the fixture 1 and the connection bent portions 13*c* of the holding portions 13*b*.

At this point, in either case, since the tip surfaces ST2 of the connection bent portions 13*c* are formed as the inclined surfaces having the angle β of about 45 degrees against the plane H (see FIG. 1), when a pressing force is applied to the upper welded wire mesh WM to connect the upper welded wire mesh WM with the connecting means 14 of the fixture 1, the vertical wire material W1 or the lateral wire material W2 disposed above and between the holding portions 13*b* slides on the tip surfaces ST2, and hence the vertical wire material W1 or the lateral wire material W2 can be easily inserted into the insertion portion 13*e*. Thus, the upper welded wire mesh WM can be connected to the connecting means 14 of the fixture 1 with one touch. Accordingly, the operation of fixing the upper welded wire mesh WM and the lower welded wire mesh WM can be completed in a short period of time without causing a worker to do heavy work.

The fixture 1 fixed on the welded wire meshes WM has the main portion 11*a* (supporting portion) molded in a U-shape as described above, and the welded wire mesh MW is fixed by the fixing portions lie disposed at the tips of the arm portions 11*d* extending in substantially parallel to the bottom portion 11*b* at the ends of the main portion 11*a*. Therefore, as illustrated in FIG. 7 and FIG. 9, the welded wire meshes WM are supported by the fixture 1 in a state spaced from the construction target surface. In this manner, the fixture 1 of the present invention also has a function as a spacer.

Accordingly, conventional construction operations of constructing and binding welded wire meshes and spacers can be performed at a time merely as follows: A plurality of fixtures 1 are precedently fixed in prescribed positions on welded wire meshes WM as described above, the resultant welded wire meshes WM are laid on a construction target surface, for example, with the welded wire meshes adjacent to each other partly superimposed on each other as illustrated in FIG. 5 and FIG. 8, and the fixing portions lie of the respective fixtures 1 are connected to vertical wire materials W1 or lateral wire materials W2 of the welded wire meshes WM.

Incidentally, the fixtures 1 may be fixed on the welded wire meshes WM in a place where the welded wire meshes are to be laid, or in a manufacturing facility of the welded wire meshes WM.

Since a desired number of fixtures 1 can be precedently fixed in prescribed positions on welded wire meshes WM in this manner, even when the positions of the welded wire meshes WM are to be adjusted because the laid welded wire meshes WM are shifted, the fixtures 1 are not shifted because the fixtures 1 are fixed on the welded wire meshes WM. Accordingly, the operation of laying the welded wire meshes WM can be completed in a short period of time without causing a worker to do heavy work.

On the other hand, the fixture 1 can be fixed in a prescribed position on the welded wire mesh WM by bringing the tip surfaces ST of the fixing portions 11*e* of the fixture 1 into contact with the circumferential surfaces of the vertical wire materials W1 adjacent to each other or the circumferential surfaces of the lateral wire materials W2 adjacent to each other, and applying a pressing force to the fixture 1 or the welded wire mesh WM, and thus, the fixture 1 can be fixed on the welded wire mesh WM with one touch. Accordingly, the operation of fixing the fixtures 1 on the welded wire meshes WM can be completed in a short period of time without causing a worker to do heavy work.

Incidentally, as described above, in the present fixture 1, the outer dimension between the first frame members 11 is set to be smaller than the inner dimension between the vertical wire materials W1 adjacent to each other or the inner dimension between the lateral wire materials W2 adjacent to each other of the welded wire mesh WM, and the outer dimension between the second frame members 12 is set to be smaller than the inner dimension between the lateral wire materials W2 adjacent to each other or the inner dimension between the vertical wire materials W1 adjacent to each other. Besides, the length dimension of the second frame members 12 is set to be smaller than the inner dimension between the vertical wire materials W1 adjacent to each other or the inner dimension between the lateral wire materials W2 adjacent to each other of the welded wire mesh WM. Therefore, the fixture 1 can be shifted in the vertical direction or the lateral direction within the square M of the welded wire mesh WM. If the operation of fixing the fixture 1 on the welded wire mesh WM is performed in a manufacturing factory, the resultant is transported by a truck or the like from the manufacturing factory to a location of the construction target. In stacking a plurality of welded wire meshes WM on the back of the truck, the fixtures 1 fixed on the welded wire meshes WM can be disposed in different positions from one another between vertically adjacent welded wire meshes WM by shifting the fixtures 1 in the vertical direction or the lateral direction in the squares M of the welded wire meshes WM. Thus, a gap between the vertically adjacent welded wire meshes WM can be made as small as possible, and hence a transport density of the welded wire meshes WM can be improved.

Figure 10:
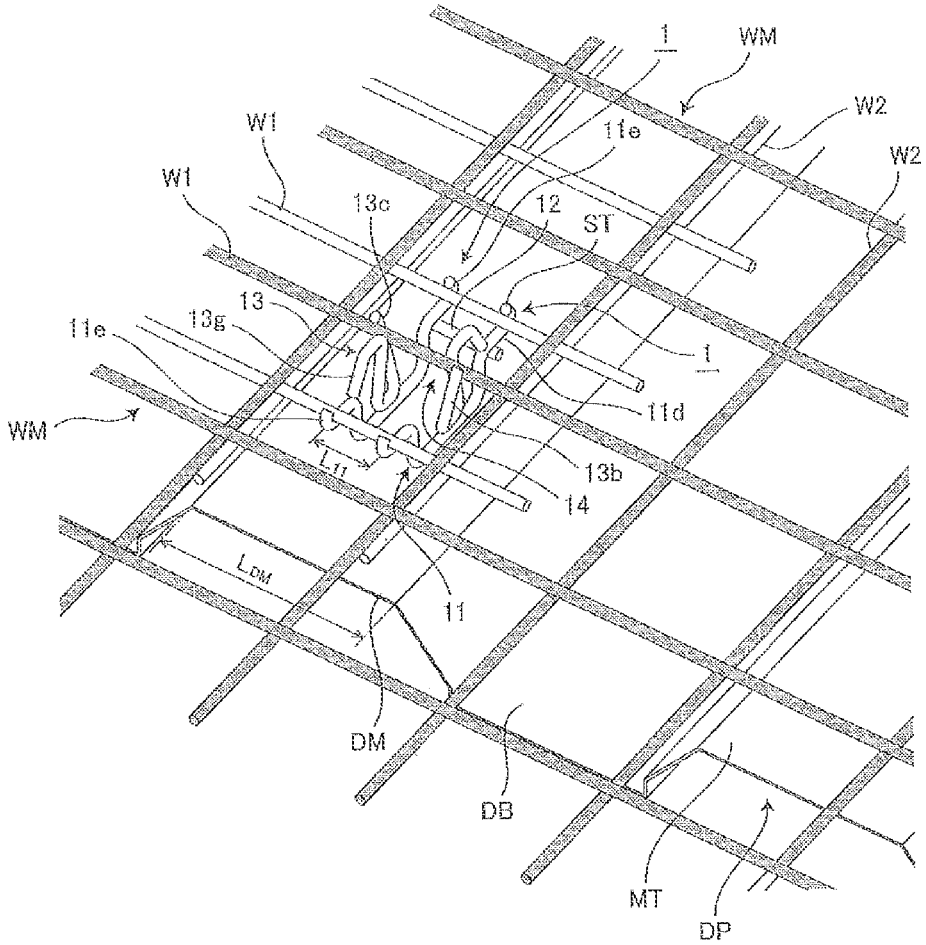
FIG. 10 is a partial perspective view illustrating a state where a welded wire mesh having a fixture attached thereon is laid on a deck plate with another welded wire mesh partly superimposed thereon and fixed with the fixture.

FIG. 10 is a partial perspective view illustrating a state where the welded wire mesh having the fixture attached thereon is laid on a deck plate with the second welded wire mesh partly superimposed thereon and fixed with the fixture. In the deck plate DP, a plurality of ridges DM are provided to project at a prescribed interval, and a portion between the ridges DM adjacent to each other is a valley DB. The fixture 1 fixed on the welded wire mesh WM is disposed on the deck plate DP with the first frame members 11 disposed in parallel to the ridges DM of the deck plate DP.

Here, a dimension $L_n$ between the first frame members 11 of the fixture 1 disposed to oppose each other is set to a value not more than ½ of a width $L_{DM}$ between the ridges DM of the deck plate DP as described above. If one of the pair of first frame members 11 included in the fixture 1 is positioned on a shoulder of the ridge DM of the deck plate DP, when a pressing force is applied to the second welded wire mesh WM superimposed on the welded wire mesh WM having the fixture 1 attached thereon to connect the vertical wire material W1 of the second welded wire mesh WM to the connecting means 14 of the fixture 1, the first frame member 1 positioned on the shoulder of the ridge DM of the deck plate DP enters the valley DB of the deck plate DP, which warps the welded wire mesh WM and the second welded wire mesh WM. In the present fixture 1, however, the dimension $L_{11}$ between the first frame members 11 of the fixture 1 is set to the value not more than ½ of the width $L_{DM}$ of the ridge DM of the deck plate DP, both the first frame members 11 are avoided from positioning on a shoulder of the ridge DM of the deck plate DP, and hence the occurrence of the warp of the welded wire mesh WM and the second welded wire mesh WM otherwise caused as described above can be prevented.

Second Embodiment

Figure 11:
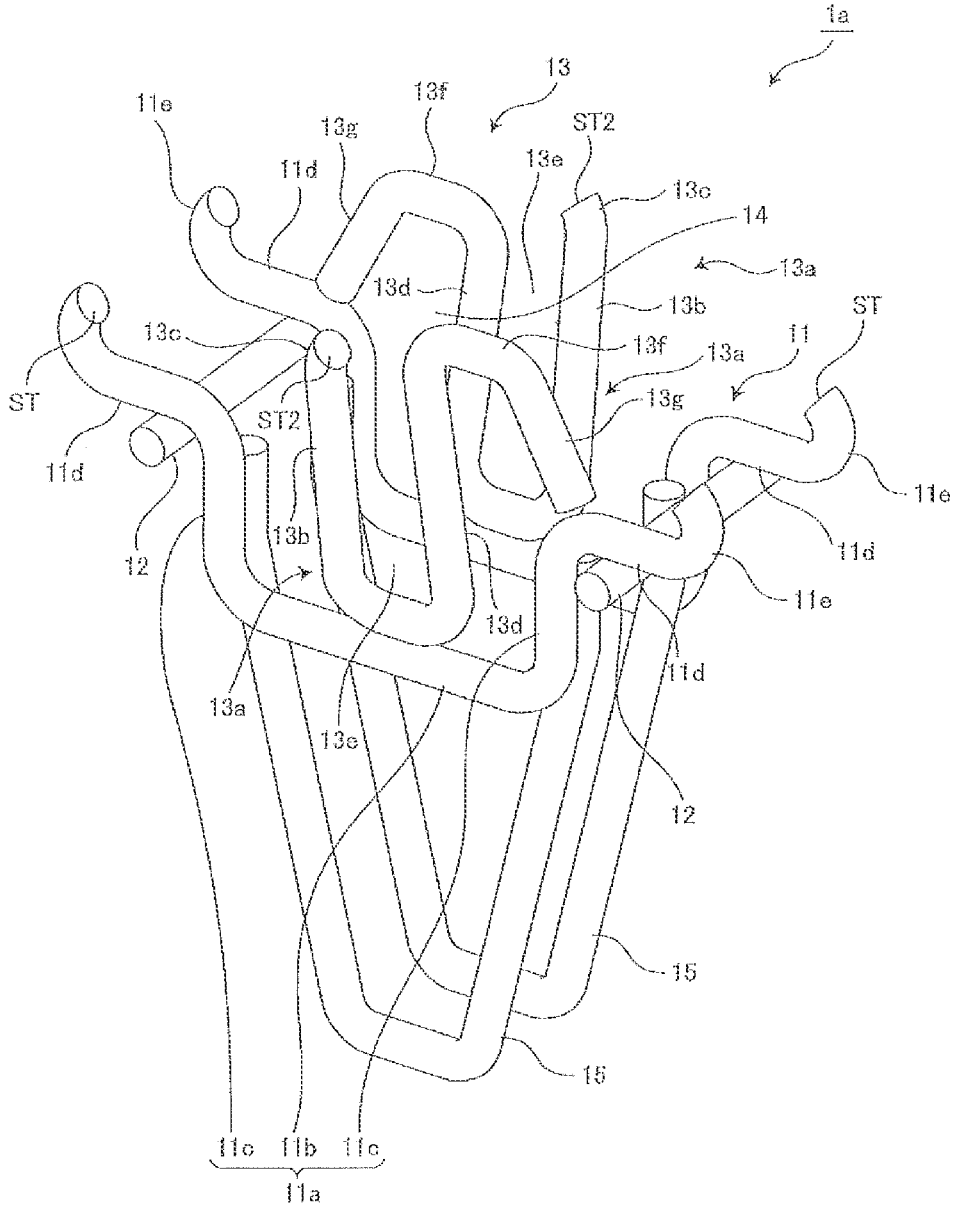
FIG. 11 is a perspective view of a fixture according to a second embodiment of the present invention.

FIG. 11 is a perspective view of a fixture according to a second embodiment of the present invention, and this fixture is formed to be placed in the valley of the deck plate described above. Incidentally, like reference signs are used in FIG. 11 to refer to the corresponding portions illustrated in FIG. 1 to avoid redundant description thereof.

As illustrated in FIG. 11, the fixture 1*a* is equipped with a pair of legs 15. The leg 15 is formed by molding a bar material into a flat-bottomed V-shape. The height dimension of the leg 15 is determined in accordance with the depth dimension of the valley of the deck plate, and as described below, a welded wire mesh supported on the fixture 1*a* is held in a position higher by a prescribed dimension than the ridge of the deck plate. Besides, the width dimension between both ends of the leg 15 is substantially the same as the dimension between the rising portions 11*c* of the first frame member 11, and both the ends of the leg 15 are fixed on inner circumferential surfaces or outer circumferential surfaces (the inner circumferential surfaces in FIG. 11) of the rising portions 11*c*.

Figure 12:
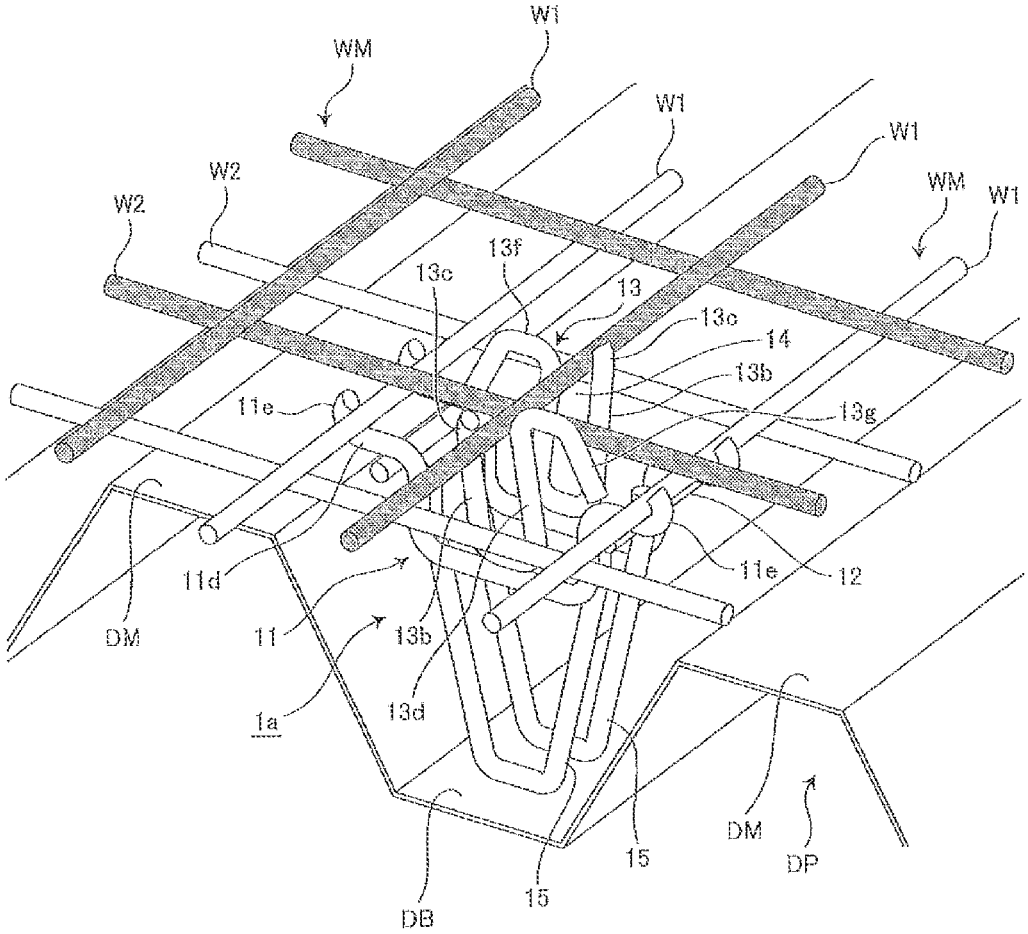
FIG. 12 is a partial perspective view illustrating an example of a state where two welded wire meshes are constructed on a deck plate by using the fixture of FIG. 11.
Figure 13:
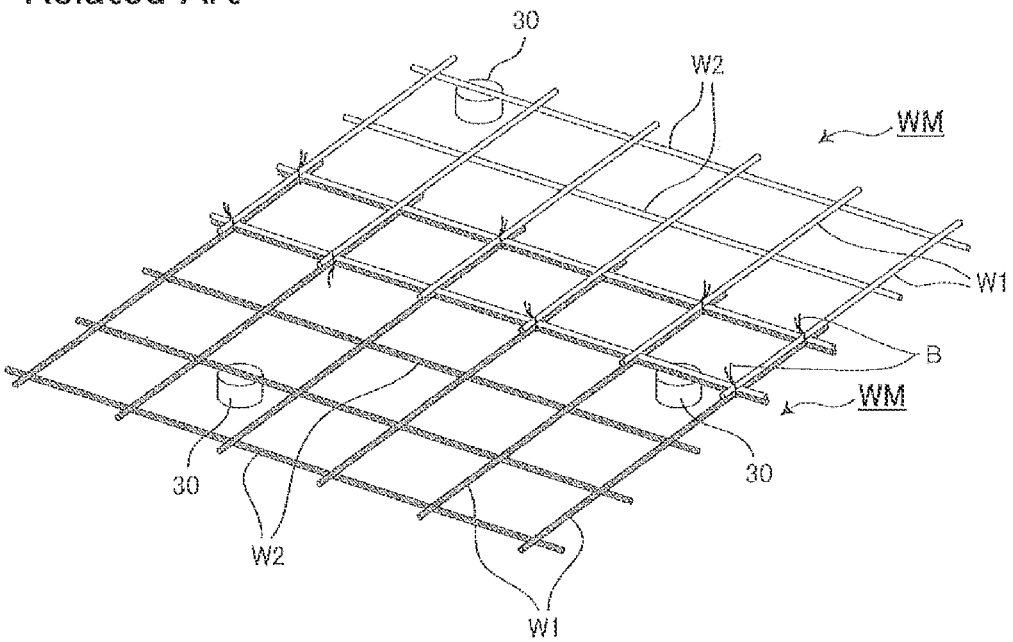
FIG.13 Related Art
FIG. 13 is an explanatory diagram illustrating a conventional construction method for a welded wire mesh.
Figure 14:
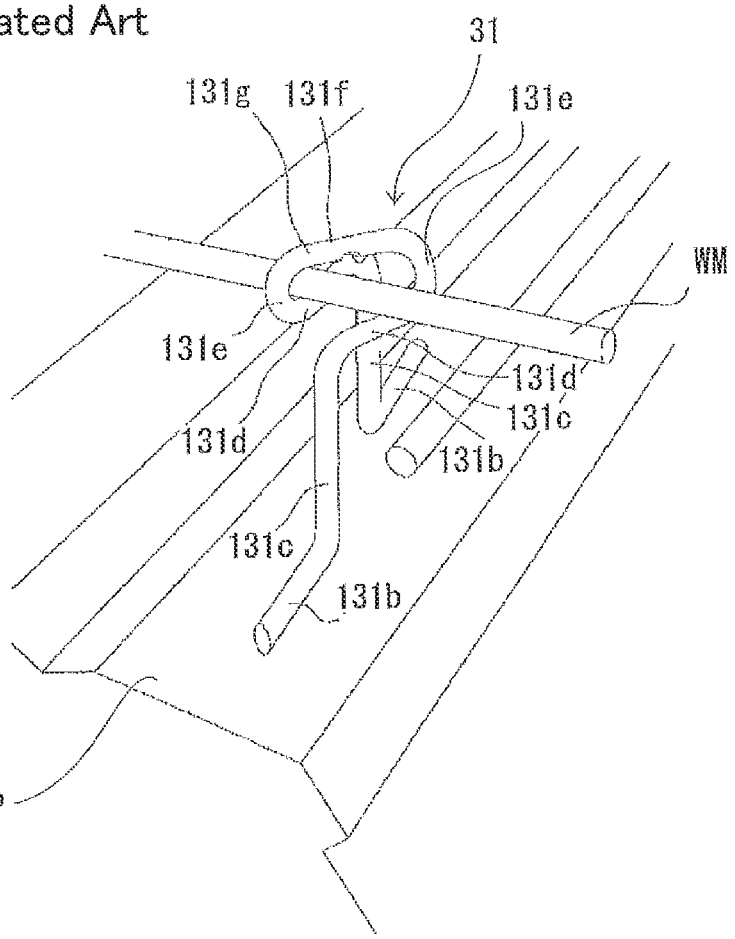
FIG.14 Related Art
FIG. 14 is a perspective view illustrating a state of use of a spacer disclosed in Patent Document 2.

FIG. 12 is a partial perspective view illustrating an example of a state where two welded wire meshes are constructed on the deck plate by using the fixture 1*a* of FIG. 11. Incidentally, like reference signs are used in this drawing to refer to the corresponding portions illustrated in FIG. 10 and FIG. 11 to avoid redundant description thereof.

As illustrated in FIG. 12, the fixture 1*a* is attached in an appropriate position on the lower welded wire mesh WM as described above with one touch, the legs 15 of the fixture 1*a* are brought into contact with the valley DB of the deck plate DP, and the lower welded wire mesh WM is disposed in a prescribed position above the deck plate DP at a prescribed distance from the ridge DM of the deck plate DP. An edge of the upper welded wire mesh WM is superimposed on the lower welded wire mesh WM, the vertical wire material W1 of the upper welded wire mesh WM is connected to the connecting means 14 of the fixture 1*a* as described above with one touch, and thus, the welded wire meshes WM are mutually fixed by the fixture 1*a*.

In this fixture 1*a*, since the upper welded wire mesh WM can be connected to the connecting means 14 of the fixture 1*a* with one touch, the operation of fixing the upper welded wire mesh WM and the lower welded wire mesh WM can be completed in a short period of time without causing a worker to do heavy work in the same manner as described above.

On the other hand, since the fixture 1*a* is provided with the legs 15, even in a position corresponding to the valley DB of the deck plate DP, the fixed welded wire meshes WM can be held at a height spaced by a prescribed distance from the ridge DM of the deck plate DP.

In the present embodiment, the flat-bottomed V-shaped legs 15 are provided, which does not limit the present invention, and it goes without saying that the shape may be any of various shapes such as a V-shape, a U-shape, a rectangular shape, and a rod shape. Alternatively, the leg may be formed by using a plate material. If the leg is formed by using a plate material, one or a plurality of through holes may be provided in the plate material. Thus, the weight of the leg can be reduced.

Incidentally, it goes without saying that the fixture 1 and the fixture 1*a* of the present invention are applicable not only to a welded wire mesh but also to another grid such as a mesh fence made of a metal or a resin.

It is to be noted that, as used herein and in the appended claims, the singular forms "a", "an", and "the" include plural referents unless the context clearly dictates otherwise.

The embodiments disclosed this time are examples in all respects, and should be considered to be not restrictive. The scope of the present invention is not limited to the above-described meaning but is indicated by the claims, and it is intended that all modifications within the meaning and scope equivalent to the claims are included. In addition, the technical features described in the respective embodiments can be combined with each other.

The invention claimed is:

1. A fixture for mutually fixing a grid and a second grid to be superimposed on the grid, the grid including a plurality of vertical wire materials and a plurality of lateral wire materials arranged in a grid shape with intersections therebetween welded, and having a plurality of squares formed by the vertical wire materials and the lateral wire materials, comprising:

at least a pair of first frame members disposed in parallel with each other at a distance according to a dimension of each square of the grid;

a pair of second frame members provided between the first frame members;

a fixing portion is provided at each end of the first frame members to be externally fit, for fixation, on each of the vertical wire materials or the lateral wire materials forming each of the squares of the grid; and connecting means having holding portions respectively provided to stand at a distance, according to an outer diameter of each of the vertical wire materials or the lateral wire materials, from each other in a lengthwise direction of the first frame members, for connecting the second grid by inserting a vertical wire material or a lateral wire material of the second grid into an insertion portion formed between the holding portions.

2. The fixture according to claim 1, wherein each end of the holding portions is bent inward of the insertion portion to form a bent portion.

3. The fixture according to claim 2, wherein a tip of the bent portion is formed as an inclined surface.

4. The fixture according to claim 3, wherein the inclined surface has an angle of about degrees against a plane parallel to a plane formed by the first frame members.

5. The fixture according to claim 1, wherein a third frame member formed by linking each of the holding portions and an arm portion opposing the holding portion is fixed on each of the first frame members.

6. The fixture according to claim 5, wherein a guiding portion for guiding the vertical wire material or the lateral wire material of the second grid toward the insertion portion is provided to extend from the arm portion of the third frame member.

7. The fixture according to claim 6, wherein the guiding portion is in a tapered shape having a height dimension reducing in a direction away from the arm portion.

8. The fixture according to claim 7, wherein a gap between the guiding portion and an opposing one of the first frame members is set to be smaller than an outer diameter of the vertical wire material or the lateral wire material of the second grid.

9. The fixture according to claim 5, wherein the holding portions are inclined inward toward between the first frame members or outward on an opposite side.

10. The fixture according to claim 1, wherein each of the first frame members is provided with a supporting portion formed by raising portions respectively spaced from ends thereof by a prescribed distance for supporting the grid fixed on the fixing portion in a height position spaced from a construction target surface.

11. The fixture according to claim 1, wherein the grid and the second grid are to be laid on a deck plate including a plurality of ridges provided to project at an appropriate interval, and having a valley between ridges adjacent to each other, and an outer dimension between the first frame members is set to be ½ or less of a width of each ridge of the deck plate.

* * * * *